United States Patent [19]

Stover et al.

[11] 4,092,968

[45] June 6, 1978

[54] ENGINE IGNITION SYSTEM

[75] Inventors: Fred Douglas Stover, Mt. Vernon; George Carl Thatcher, Centerburg, both of Ohio

[73] Assignee: Cooper Industries, Inc., Houston, Tex.

[21] Appl. No.: 766,883

[22] Filed: Feb. 9, 1977

[51] Int. Cl.[2] ..... F02P 1/00; F02P 7/02; F02P 9/00

[52] U.S. Cl. ..... 123/148 E; 123/146.5 A

[58] Field of Search ..... 123/148 E, 32 EA, 146 SA, 123/148 CA, 148 F, 148 P, 148 NO, 146.5 R, 117 R, 32 EF

[56] References Cited

U.S. PATENT DOCUMENTS

| | | | |
|---|---|---|---|
| 3,621,826 | 11/1971 | Chrestenson | 123/148 E |
| 3,788,285 | 1/1974 | Gelin et al. | 123/32 EA |
| 3,868,938 | 3/1975 | Trass | 123/148 E |
| 3,955,723 | 5/1976 | Richards | 123/148 E |

*Primary Examiner*—Charles J. Myhre
*Assistant Examiner*—R. A. Nelli
*Attorney, Agent, or Firm*—Oliver E. Todd, Jr.

[57] ABSTRACT

An optical electronic ignition system for industrial internal combustion engines. Light reflective markers on an optical timing disc rotated by the engine are sensed by a timing module to generate an electric pulse for initiating each spark. Each pulse simultaneously energizes optical scanners in separate distributor modules for each combustion chamber. Only the scanner scheduled to fire by reflective alignment of a separate distribution marker located elsewhere on the timing disc will trigger a related capacitive discharge ignition circuit associated with the related combustion chamber. More than one scanner may be scheduled for simultaneous firing. A single conductor carries both uniform capacitor charging current and trigger signals to the capacitive discharge ignition circuit associated with each combustion chamber. An inductive loop in the low voltage lead to an ignition coil in a capacitive discharge ignition circuit provides a signal for operating a timing light. Indicators are provided for continuously monitoring operation of various portions of the ignition system.

11 Claims, 2 Drawing Figures

ENGINE IGNITION SYSTEM

BACKGROUND OF THE INVENTION

This invention relates to ignition systems suitable for internal combustion engines and more particularly to a highly reliable ignition system in which optically generated signals selectively trigger individual capacitive discharge ignition circuits for each combustion chamber in the engine.

Ignition systems for modern internal combustion engines often employ capacitive discharge circuits. In such circuits, a storage capacitor is periodically charged from a D.C. voltage source and then a gated electronic switch such as a triac or a silicon controlled rectifier (SCR) is triggered into conduction to discharge the capacitor through the primary winding of an ignition coil. The resulting high voltage output from the ignition coil is applied through a distributor to a preselected spark plug for initiating ignition within an engine cylinder. Originally, capacitive discharge ignition systems were triggered by a conventional set of cam operated breaker points. More recently, the breaker points sometimes have been replaced with other types of trigger signal sources, such as inductive pick-ups, magnetic pick-ups and optical sensors.

Although prior art ignition systems have been satisfactory for many applications, such as in automotive engines, they have not been altogether satisfactory for industrial applications for various reasons. Many industrial internal combustion engines are operated in environments which require a high degree of reliability and an explosion-proof construction. For example, reliability is of the utmost importance in an internal combustion engine used for driving a pump installed in a crude oil pipeline in cold environments such as in Alaska. If the pump is stopped for more than a few minutes, the crude oil will solidify and block the pipeline due to the cold temperatures. On the other hand, in an engine operated on an off-shore oil platform in the Gulf of Mexico, the ignition system must be of an explosion-proof construction to prevent the ignition system from accidentally starting a fire or causing a catastrophic explosion which would not only destroy the expensive platform and related equipment, but would also endanger the lives of many people working on the off-shore platform. Exposed arcing at conventional breaker points and distributors, for example, can easily cause a fire or an explosion when an engine is operated in an explosive environment.

SUMMARY OF THE INVENTION

According to the present invention, an advanced, highly reliable, explosion-proof ignition system is provided for industrial internal combustion engines. The ignition system is enclosed and sealed to prevent explosions when operated in explosive environments and also to attenuate radio frequency emissions which could interfere with nearby communications and control equipment. A rotatable shaft is mounted to extend through a wall of a sealed housing. The external end of the shaft is driven in synchronism with the internal combustion engine in which the ignition system is operated. Within the housing, the shaft drives the rotor of an alternator and also rotates a timing disc having a plurality of tracks and, on each track at least one light reflective marker. Optical scanners or sensors, each including a light emitting diode (LED) and a phototransistor, are mounted in alignment with each separate track for sensing the related markers on the timing disc. A first optical scanner in a scanning module simulates prior art breaker points by generating a pulse train, with each pulse in the train occurring at the time ignition is to be initiated in any combustion chamber in the engine. A separate distribution module containing an optical scanner is provided for each combustion chamber within the engine. The LEDs in all distribution modules for the engine are simultaneously illuminated each time a pulse is generated by the first optical scanner. At any given time, a marker will be located adjacent the optical scanner for only the combustion chamber, or chambers, which is to be ignited or fired. The output from the optical scanner is amplified and used to drive a switching transistor into a state of conduction. A separate capacitive discharge circuit is also provided for each combustion chamber. A storage capacitor in each capacitive discharge circuit is charged through a current limiting circuit in an associated one of the distribution modules. When the switching transistor in such distribution module is biased into conduction by the output from an optical scanner, the charging current to the capacitor is interrupted and a resulting voltage decrease on the gate of a triac triggers the triac to discharge the capacitor through the primary winding of one or more ignition coils. Often, two ignition coils are connected with their primary windings in parallel for simultaneously firing two spark plugs in a combustion chamber to increase the reliability of the engine and also to increase the efficiency of the engine by providing two flame propagation points. By providing separate capacitive discharge ignition circuits for each combustion chamber, such circuits may be located adjacent the cylinders. This in turn reduces the lengths of the primary circuit wiring between the capacitor and the ignition coil. As the length of such primary circuit wiring is decreased, the inductive and capacitive coupling between adjacent primary circuits in a conduit header similarly is decreased. By providing an integral capacitive discharge circuit and ignition coil for each combustion chamber, the primary circuit is completely removed from the ignition header, thus eliminating the inductive and capacitive coupling between primary circuits. This inductive and capacitive coupling has long been a source for false triggering of semiconductors, causing inappropriate firing or "crosstalk".

To facilitate maintenance of the ignition system, the various modules including the timing module and the distributor modules are mounted on plug-in printed circuit boards. LED indicators are located on each printed circuit board and in each capacitive discharge circuit for indicating the correct operation of such modules. In the event of a failure, a service person need only to locate the LED indicator which is not functioning and to replace that module. As a consequence, maintenance is readily performable on the ignition system with a minimum down time for the engine.

Accordingly, it is an object of the invention to provide an improved ignition system for internal combustion engines and particularly for engines used in hazardous and/or industrial applications.

Another object of the invention is to provide an ignition system for internal combustion engines having a very high degree of intrinsic electrical noise immunity.

Other objects and advantages of the invention will become apparent from the following detailed description, with reference being made to the accompanying drawings.

DESCRIPTION OF THE PREFERRED EMBODIMENTS

Figure 1:
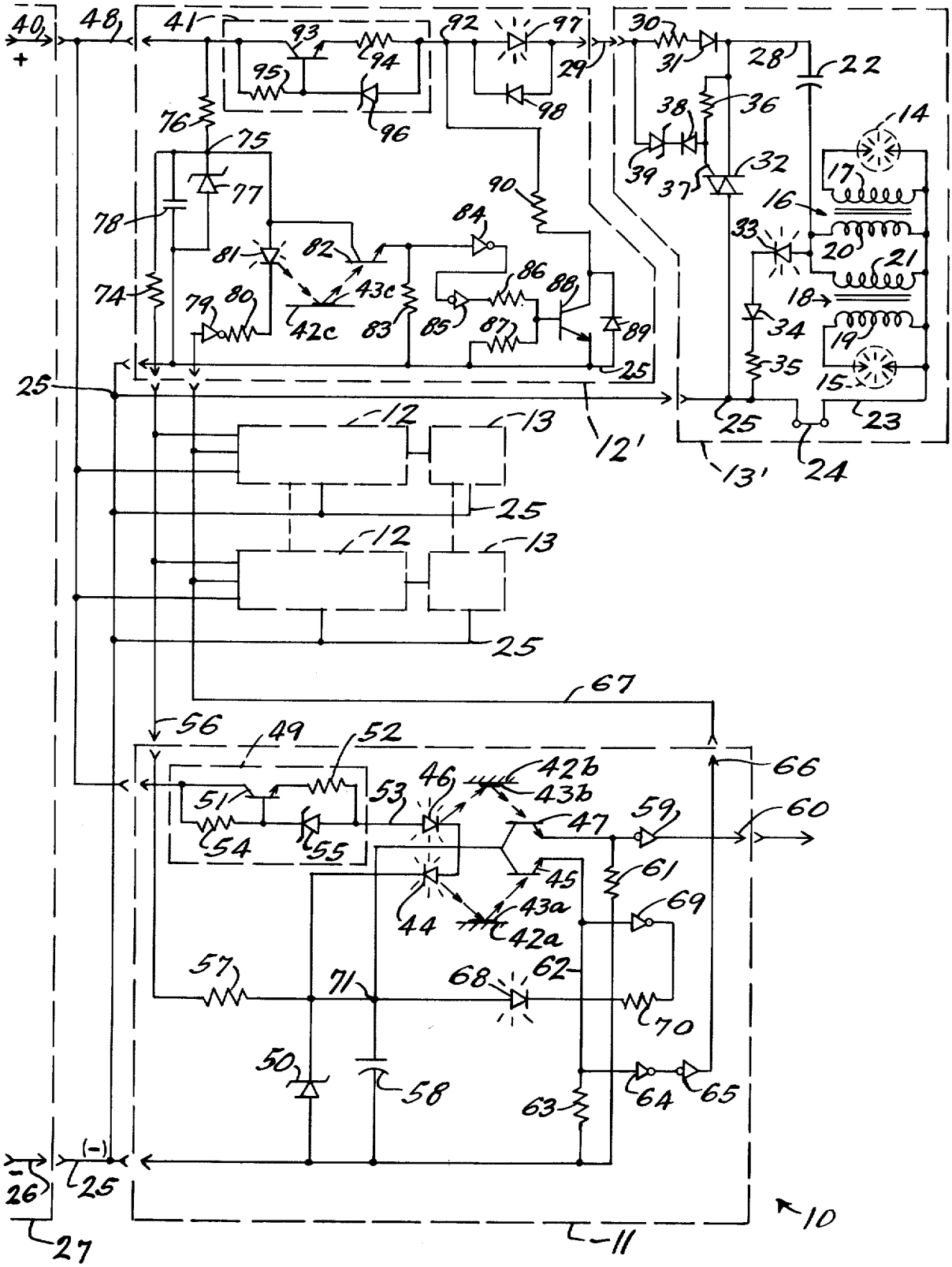
FIG. 1 is a schematic circuit diagram of an improved ignition system for an internal combustion engine constructed in accordance with the present invention.

Turning now to FIG. 1 of the drawings, a schematic circuit diagram is shown for an ignition system 10 constructed in accordance with the present invention for use in an internal combustion engine. The ignition system 10 generally consists of a single timing module 11, a plurality of distribution modules 12 and a like plurality of capacitive discharge modules 13. A separate distribution module 12 and a separate capacitive discharge module 13 is provided for each combustion chamber of the engine. In the drawing of FIG. 1, each of the blocks 12 represents a different distribution module and the exemplary distribution module 12' is shown in detail. Similarly, each of the blocks 13 represents a different capacitive discharge module for each cylinder and the exemplary capacitive discharge module 13' is shown in detail. It should be appreciated that FIG. 1 is exemplary and that for a multiple cylinder engine such as a twenty cylinder engine, twenty separate distribution modules 12 and twenty separate capacitive discharge modules 13 will be incorporated into the ignition system 10.

For industrial internal combustion engines, it is often desirable to provide two spark plugs 14 and 15 for each cylinder both for increasing the reliability of the engine and also for providing two flame propagation points to increase the efficiency of the engine. The capacitive discharge module 13' includes an ignition coil 16 having a secondary winding 17 connected to supply high voltage to fire the spark plug 14 and an ignition coil 18 having a secondary winding 19 connected to supply a high voltage to fire the spark plug 15. Primary windings 20 and 21 in the ignition coils 16 and 18, respectively, are connected in parallel between a storage capacitor 22 and a negative terminal 23. The negative terminal 23 is connected through a current loop 24 to a negative or ground bus 25 which is electrically connected to the engine frame and ultimately is connected to a negative output terminal 26 from an alternator 27, or other suitable power source. The remaining side of the storage capacitor 22 is connected to a junction 28. In addition to the ground bus 25, a single conductor 29 is connected between the distribution module 12' and the capacitive discharge module 13' for supplying a high voltage constant charging current to the capacitor 22 and also for supplying a trigger signal to the capacitive discharge module 13'. The conductor 29 is connected through a resistor 30 and a diode 31 to the junction 28 for charging the storage capacitor 22 to a high voltage, such as approximately 400 volts. An electronic switch, such as a triac 32 or an SCR or other suitable switch, is connected between the junction 28 and the ground bus 25. During charging of the capacitor 22, the triac 32 is in a non-conducting state. When the triac 32 is switched into a conducting state, the capacitor 22 is discharged through the triac 32, the current loop 24 and the parallel primary windings 20 and 21 of the ignition coils 16 and 18, respectively, for applying ignition voltages from across the secondary windings 17 and 19 to the spark plugs 14 and 15. An LED indicator 33, a diode 34 and a resistor 35 are connected in series from the junction between the primary windings 20 and 21 and the storage capacitor 22 to the ground bus 25 for indicating that the capacitive discharge module 13' is operating correctly. The LED indicator 33 will blink in synchronism with the triggering of the triac 32 when the capacitive discharge module 13' is operating.

A resistor 36 is connected from the junction 28 to a gate terminal 37 on the triac 32. The gate terminal 37 is also connected through a diode 38 and a Zener diode 39 to the conductor 29. Normally, a high voltage positive output terminal 40 from the alternator 27 is connected through a current limiter 41 within the distributor module 12' to supply a limited current over the conductor 29 and through the resistor 30 and diode 31 for charging the capacitor 22. At this point, the triac gate 37 will have substantially the same voltage as the voltage on the junction 28. Triggering of the triac 32 is initiated by a substantial decrease in the voltage on the conductor 29. When the voltage on the conductor 29 drops, current will flow from the storage capacitor 22 through the resistor 36, and main terminal one of the triac 32 through its gate junction 37, the diode 38 and the Zener diode 39 to the conductor 29. The current through the triac 32 main terminal one and its gate junction is sufficient to trigger the triac 32 into conduction, thereby discharging the capacitor 22 through the ignition coils 16 and 18.

It should be noted that when the triac 32 is triggered to discharge the capacitor 22 to the ignition coils 16 and 18, current flows through the current loop 24. The magnetic field established in the vicinity of the current loop 24 provides a signal for driving a timing light for the engine in which the ignition system 10 is operated. Through this arrangement, it is not necessary to sense the high voltage outputs from either ignition coils 16 or 18 for timing the engine. When an ignition system is totally enclosed, it is not possible with prior art systems to time an engine without defeating the sealed enclosures. This problem is eliminated through the use of the current loop 24 which provides a signal to a timing light without breaking the integrity of shielding for the capacitive discharge module 13' or shielding on high voltage cables connected to the spark plugs 14 and 15.

The ignition system 10 includes an optical system for generating signals for selectively triggering the capacitive discharge modules 13 in the proper sequence and at the proper time. The optical system includes a timing disc which is rotated by, and in synchronism with, the internal combustion engine. The timing disc includes a plurality of tracks which are scanned by optical sensors or scanners. Fragments of three such tracks are depicted in FIG. 1 by the reference numbers 42*a*, 42*b* and 42*c*. Preferably, the timing disc is provided with a blackened surface and one or more light reflective dots or markers in each track. In FIG. 1, a marker 43*a* is shown on track 42*a*, a marker 43*b* is shown on track 42*b* and a marker 43*c* is shown on track 42*c*. Each track may have one or more markers. For example, the track 42*a* may have twenty of the markers 43*a* spaced uniformly about the timing disc for producing a strobe signal or pulse each time a different one of twenty engine cylinders is to be fired. The track 42*b* is a tachometer track designed for generating a pulse train having a frequency proportional to the speed of the engine. The tachometer track 42*b* also may be operated as a counter reset from a flywheel pick-up to indicate event degrees such as ignition timing.

An optical scanner or sensor consisting of an LED 44 and a phototransistor 45 are positioned adjacent the track 42*a* for sensing the presence and absence of the light reflecting marker 43*a*. The LED 44, when energized, emits infrared light which is directed towards the track 42*a*. When the timing disc rotates to a position that a marker 43*a*, which may be in the form of a chrome plated rectangular pad, is beneath the LED 44 and the phototransistor 45, the infrared light is reflected to the phototransistor 45 to switch it into a state of conductivity. An optical scanner in the form of an LED 46 and a phototransistor 47 are similarly placed adjacent the track 42*b* for sensing the markers 43*b*.

The positive output terminal 40 from the alternator 27 is connected to a positive bus 48 which is connected in parallel to each of the distributor modules 12 and to the timing module 11. The positive bus 48 is connected within the timing module 11 through a series circuit consisting of a current limiter 49, the two scanner LEDs 46 and 44 and a Zener diode 50 and an indicating LED 68 switched by an inverter 69 and both paralleled with a Zener diode 50 and each branch of which is connected to the ground bus 25. The current limiter 49 includes a transistor 51 having a collector connected to the positive bus 48 and an emitter connected through a resistor 52 to its output junction 53. The base of the transistor 51 is connected through a resistor 54 to the positive bus 48 and through a Zener diode 55 to the output junction 53. The output junction 53 is then connected through the series scanner LEDs 46 and 44 and ultimately through Zener diode 50 and/or when switched the indicating LED 68 through the inverter 69 to the ground bus 25 which completes the circuit. The values of the resistors 52 and 54 and the Zener diode 55 in the current limiter 49 are selected to provide a predetermined current, such as 20 ma, to energize the LEDs 46 and 44. A low voltage positive bus 56 is connected to all of the distributor modules 12 and 12' and to a resistor 57 within the breaker module 11. The resistor 57 is connected to a junction 71 and to a capacitor 58 and to the collectors of the phototransistors 45 and 47, in parallel. When the engine is operating, the phototransistor 47 has a pulse output applied through an inverter-amplifier 59 to an output terminal 60 for driving a tachometer and/or a position counter. The emitter of the scanner phototransistor 47 is also connected through a resistor 61 to the ground bus 25. Thus, the inverter 59 will have an input appearing substantially at the voltage of the ground bus 25 during the absence of a marker 43*b* and will have a positive input at substantially the level of the voltage on the junction 71 when light from the scanner LED 46 is reflected by a marker 43*b* to the scanner phototransistor 47.

The emitter from the scanner phototransistor 45 is connected to a junction 62 which is in turn connected through a resistor 63 to the ground bus 25. The junction 62 is connected through two series connected inverter-amplifiers 64 and 65 to an output terminal 66 which is in turn connected by means of a printed circuit conductor 67 to each of the distributor modules 12. When a marker 43*a* directs light from the scanner LED 44 to the scanner phototransistor 45, the scanner phototransistor 45 will conduct to apply a voltage from the junction 71 to the junction 62. This voltage pulse is in turn amplified by means of the inverter-amplifiers 64 and 65 and applied as a strobe signal to the printed circuit conductor 67. The LED indicator 68 is provided for showing that the timing module 11 is operating. The junction 62 is connected through an inverter-amplifier 69 and a resistor 70 to one side of the indicator 68 and the other side of the indicator 68 is connected to the low voltage junction 71. As a consequence, the indicator 68 will blink in synchronism with the output from the scanner phototransistor 45 when the timing module 11 is functioning correctly.

The low voltage positive printed circuit conductor 56 is connected through a resistor 74 to a low voltage junction 75 within all distributor modules 12. The junction 75 is connected through a thermistor 76 to the high voltage positive bus 48 and through a parallel Zener diode 77 and filter capacitor 78 to the ground bus 25. The Zener diode 77 is selected to provide a predetermined low voltage, such as 12 volts, on the junction 75. The printed circuit conductor 67 from the timing module 11 on which the strobe signals are applied for initiating firing of the various spark plugs within the engine is connected in the distribution module 12' through an inverter-amplifier 79, a resistor 80 and an LED 81 to the junction 75. As a consequence, the LED 81, and all similar LEDs in the other distributor modules 12, is illuminated each time the scanner phototransistor 45 in the timing module 11 receives infrared energy reflected from the scanner LED 44. The LED 81 functions in combination with a phototransistor 82 as an optical scanner for sensing the presence and absence of a reflective marker 43*c* on the timing disc track 42*c*. Each time a strobe pulse is applied to the printed circuit conductor 67 by the timing module 11, only one marker or more, such as the marker 42*c* within the distributor module 12', will be located for generating an output from the optical scanner within a distributor module for firing the spark plugs for a single cylinder in the engine. The timing disc is rotated and the markers are placed on the timing disc such that the phototransistor 82 will sense light from the LED 81 only once per revolution of the engine drive shaft for a two cycle engine and only once per two revolutions of the engine drive shaft for a four cycle engine.

The phototransistor 82 has a collector connected to the low voltage positive junction 75 and an emitter connected through a resistor 83 to the ground bus 25. The emitter signal passes through a series circuit including two inverter-amplifiers 84 and 85 and a voltage divider formed from two resistors 86 and 87. The junction between the two resistors 86 and 87 is connected to the base of a transistor 88. Normally, the transistor 88 is in a non-conducting state. However, when the phototransistor 82 senses infrared radiation reflected from a marker 43*c* on the timing track 42*c*, the transistor 88 is changed to a conductive state. The transistor 88 has an emitter connected to the ground bus 25. A diode 89 is connected in parallel between the collector and the emitter of the transistor 88 to prevent back EMF from the inductive circuit to appear across the transistor 88. The collector of the transistor 88 is connected through a resistor 90 to an output junction 92 from the current limiter 41.

The current limiter 41 in the distributor module 12' is similar to the current limiter 49 in the timing module 11 and includes a transistor 93 having a collector connected to the positive bus 48 and an emitter connected through a resistor 94 to the output junction 92. A resistor 95 is connected between the base and collector of the transistor 93 and a Zener diode 96 is connected between the base of the transistor 93 and the output junction 92. The resistors 94 and 95 and the Zener diode 96 are selected to apply a predetermined maximum current, e.g., 20 ma at 400 volts, from the positive bus 48 to the output junction 92. Normally, the current applied to the output junction 92 flows through an LED indicator 97 and the conductor 29 to the capacitive discharge circuit 13' for charging the storage capacitor 22. However, when a marker 43c on the timing track 42c reflects light from the LED 81 to the phototransistor 82, the transistor 88 is biased into conduction for connecting the junction 92 through the resistor 90 to the ground bus 25. This results in an appreciable drop in the voltage on the conductor 29. As a consequence, the higher voltage on the storage capacitor 22 causes a current to flow to the triac 32, main terminal one through its gate junction 37 to the diode 38, the Zener diode 39, the conductor 29, a diode 98, the resistor 90, the transistor 88 and to the ground bus 25. This current through the triac 32 main terminal one and its gate junction 37 in the capacitor discharge module 13 is sufficient to trigger the triac 32 and, thereby, discharging energy stored in the capacitor 22 through the ignition coils 16 and 18 for generating a high voltage. From the above description, it should be appreciated that the single conductor 29 carries not only the charging current for the storage capacitor 22, but also carries the trigger signal for initiating discharge of the capacitor 22 through the primary windings 20 and 21 of the ignition coils 16 and 18. So long as charging current is flowing over the conductor 29, such current flows through the LED indicator 97. Therefore, the indicator 97 will remain on for most of the cycle and will be turned off only during the short interval that the transistor 88 is biased into a conducting state for generating a trigger signal. The LED indicator 97 in the distributor module 12' and similar indicators in the other distributor modules 12, the LED indicator 33 in the capacitive discharge module 13' and similar indicators in the other capacitive discharge modules 13 and the LED indicator 68 in the timing module 11 provide a positive indication that the ignition system 10 is functioning properly. In the event that one of the modules 11, 12 or 13 should fail, such failure will be displayed immediately on the indicator for that module. The ignition system 10 may then be quickly serviced by replacement of that module with a minimum down time of the engine.

Figure 2:
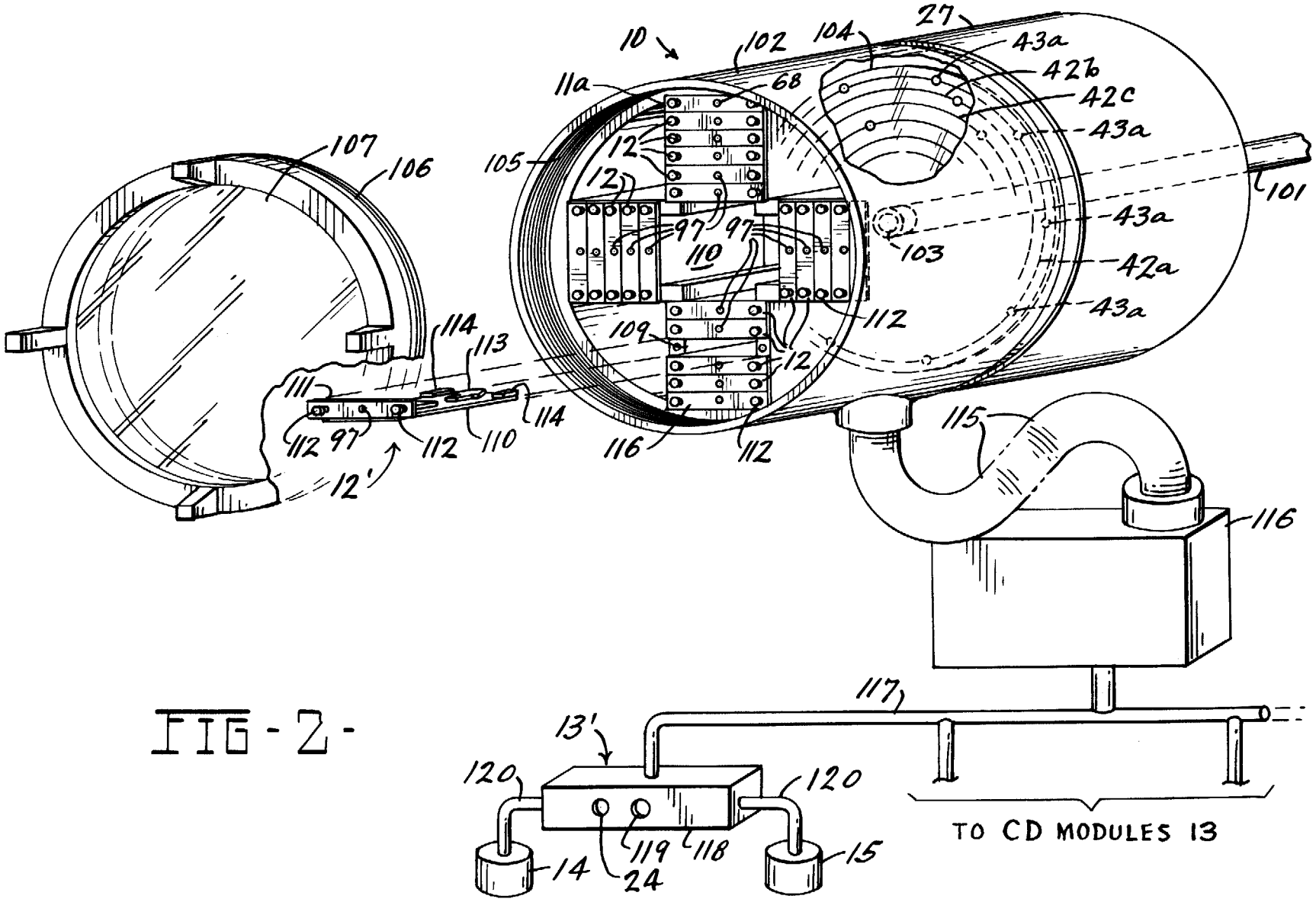
FIG. 2 is a fragmentary exploded perspective view of an ignition system for an internal combustion engine constructed in accordance with the present invention.

Turning now to FIG. 2, a fragmentary exploded perspective view is shown of an ignition system 10 constructed in accordance with the present invention. It should be noted that the various components of the ignition system 10 are shown pictorially and not to scale. A shaft 101 driven in synchronism with the engine is connected to drive the alternator 27 which is mounted within an explosion-proof housing. A second explosion-proof chamber 102 is mounted adjacent to the alternator 27 for enclosing the timing module 11 and the individual distributor modules 12 for each of the cylinders in the engine. The shaft 101 is geared to the engine and, for a four cycle engine, is geared to turn at one half the speed of the engine drive shaft. The shaft 101 extends through the alternator 27 and into the chamber 102 and has a hub 103 to which a timing disc 104 is attached. The timing disc is preferably formed with a blackened surface and defined thereon a plurality of concentric annular tracks 42. At predetermined locations on the tracks 42, light reflecting markers 43 are attached for generating timing and control signals. The chamber 102 has a threaded end 105 for receiving a correspondingly threaded cover 106. When the cover 106 is positioned on the chamber 102, an explosion-proof container is defined for holding the timing module 11 and the distributor modules 12. The cover 106 is provided with an explosion-proof window 107 which permits viewing the indicator 68 in the timing module 11 and the indicators 97 in the distributor modules 12.

The timing module 11 and the individual distributor modules 12 are adapted to slide into racks 108 mounted within the chamber 102. The timing module 11 and the distributor modules 12 are constructed on flat printed circuit boards which slide into spaced grooves 109 formed within the racks 108. The timing module 11 is shown divided into two sections **11*a* and 11*b*, one of which mounts the optical scanner consisting of the LED 44 and the phototransistor 45 and the other of which mounts the optical scanner consisting of the LED 46 and the phototransistor 47. As shown on the exemplary distributor module 12' which is removed from the rack 108, the module 12' includes a printed circuit board 110 and an attached front panel 111 on which the LED indicator 97 is mounted and two mounting screws 112 are attached. An optical scanner module 113, which includes the LED 81 and the phototransistor 82, is mounted at the back of the printed circuit board 110 along with two connectors 114. When the distributor 12' is positioned within the rack 108 and locked in place by means of the screw 112, the optical scanner module 113 is positioned for scanning a predetermined one of the tracks 42 for sensing the presence and absence of infrared reflective markers 43 on such track. The output from each distributor module 12 is carried through a shielded conduit 115, a junction box 116 and shielded distributor conduits 117 to the associated capacitive discharge module 13. As shown in the fragmentary drawing of FIG. 2, the capacitive discharge module 13' is enclosed within a shielded housing 118 and includes a window 119 for viewing the LED indicator 33. The current loop 24 also may be located next to the window 119 for driving a timing light located outside the housing 118 without opening the housing 118. By providing a separate capacitive discharge module 13 for each cylinder, each capacitive discharge module 13** is located adjacent its associated engine cylinder.

It will be noted from reviewing the schematic of FIG. 1, that the ignition system 10 will continue to function if the timing module 11 is eliminated and a continuous signal is applied to the strobe cable 67. This will continuously energize the LED 81 in the distributor module 12' and the similar LEDs in the other distributor modules 12. Each distributor module 12 will then generate a signal for triggering its associated capacitive discharge module 13 when a marker 43 is detected on the timing disc track 42 scanned by such distributor module. However, there may be a tolerance problem in maintaining the proper firing times in each of the individual cylinders. Although the markers may be accurately placed on the timing disc through the use of photographic manufacturing techniques, there is a considerable variation in the sensitivity of optical sensors of the type such as the LED 81 and the phototransistor 82 in the distributor module 12'. It should also be appreciated from viewing FIG. 2 that the various timing tracks 42 on the timing disc 103 are concentric with the shaft 101. The smaller diameter timing tracks are much more critical than the larger diameter timing tracks because of the great difference in the distance covered along a small diameter timing track versus a large diameter timing track for each degree of revolution of the shaft 101. The timing module 11 is provided to eliminate such tolerance problems. Preferably, the track 42*a* on the timing disc is the largest diameter track. Through photographic techniques, the individual markers 43*a* may be uniformly spaced about the track 42*a*. The other markers on the other timing tracks are then formed much larger than is necessary to eliminate possible tolerance problems. Thus, the individual marker for a distributor module which is to generate a trigger signal such as the marker 43*c* for the distributor module 12', will be located beneath the LED and the phototransistor when a strobe signal is applied by the timing module 11 to the printed circuit conductor 67.

Although a specific preferred embodiment has been described above for the ignition system 10 of the present invention, it will be appreciated that various modifications and changes may be made without departing from the spirit and the scope of the following claims. For example, although the ignition system 10 is described as being mounted in an explosion-proof chamber, the chamber need not meet explosion-proof standards if the ignition system is to be operated in a non-hazardous location. Or, the chamber may be adapted to protect the ignition system from a corrosive environment rather than an explosive environment. In addition, a specific type of optical scanner has been described which incorporates an LED infrared light source and a phototransistor. The phototransistor is positioned for receiving light reflected from light reflective markers on a timing disc. In a modified embodiment, the timing disc may be provided with transparent and opaque areas in each track being scanned. The light source is positioned on one side of the timing disc with the light sensor positioned on the other side for sensing light passing through the timing disc. In still another embodiment, the optical sensors are replaced with magnetic sensors or inductive sensors which detect the presence and absence of either magnets or ferromagnetic materials for generating strobe signals. The timing disc is modified by using magnets or ferromagnetic spots as the markers. The alternator 27 may be provided as an integral part of the ignition system 10, as shown in FIG. 2, or it may be replaced in some cases with the low voltage power system found with conventional engines and a converter for converting such low voltage to a higher voltage, such as 400 volts D.C. It also should be noted that the ignition system 10 is adaptable to various types of spark ignited internal combustion engines, such as piston engines and Wankle engines.

What we claim is:

1. An ignition system for a multiple combustion chamber internal combustion engine comprising, in combination, a timing disc, means for rotating said timing disc in synchronism with the engine, first sensor means scanning a predetermined track on said timing disc as said timing disc is rotated for generating first signals in response to predetermined portions of said track, a separate second sensor means and a separate capacitive discharge circuit means associated with each combustion chamber in the engine, said second sensor means scanning predetermined tracks on said timing disc as said timing disc is rotated for selectively generating second signals in response to the sensing of predetermined portions of such scanned tracts during the occurrence of such first signal, each of said capacitive discharge circuit means including a storage capacitor, an ignition coil having a primary winding and electronic switch means for discharging said capacitor through said primary winding, means for charging said capacitor, and means responsive to a second signal from a second sensor means for triggering the electronic switch means in said capacitive discharge circuit means associated with such second sensor means.

2. An ignition system for a multiple combustion chamber internal combustion engine, as set forth in claim 1, wherein said means for charging the capacitor in each capacitive discharge circuit means includes conductor means connected for supplying a charging current to such capacitor, and wherein a second signal from a second sensor means is applied to the associated capacitive discharge circuit means on said conductor means connected to charge said capacitor in such capacitive discharge circuit means.

3. An ignition system for a multiple combustion chamber internal combustion engine, as set forth in claim 2, further including a D.C. power source, and wherein said means for charging the capacitor in a capacitive discharge circuit means includes means for supplying a limited current from said power source through a connected conductor means to such capacitor, and wherein said second sensor means associated with such capacitive discharge circuit means decreases the voltage on such connected conductor means in response to the sensing of said predetermined portion of the track sensed by such second sensor means during the occurrence of such first signal, such voltage decrease on such connected conductor means comprising a second signal.

4. An ignition system for a multiple combustion engine, as set forth in claim 1, and including a plurality of illuminated indicator means, and wherein a different one of said indicator means indicates a failure of said first sensor means, each of said second sensor means and each of said capacitive discharge circuit means.

5. An ignition system for a multiple combustion chamber internal combustion engine, as set forth in claim 1, and further including an inductive loop for each capacitive discharge circuit means, means mounting each inductive loop in a series circuit with the electronic switch means, the capacitor and the ignition coil primary winding in a capacitive discharge circuit means whereby current flowing in such series circuit when such electronic switch means is triggered establishes a field about such inductive loop for triggering a remote engine timing light.

6. An ignition system for a multiple combustion chamber internal combustion engine, as set forth in claim 1, and further including a first explosion-proof chamber enclosing said timing disc and said first and second sensor means, and a plurality of second explosion-proof chambers, each of said second chambers enclosing a different one of said capacitive discharge circuit means.

7. An ignition system for a multiple combustion chamber internal combustion engine comprising, in combination, a timing disc, means for rotating said timing disc in synchronism with the engine, a separate sensor means and a separate capacitive discharge circuit means associated with each combustion chamber in the engine, each sensor means including a light source and a light detector, said sensor means scanning predetermined tracts on said timing disc as said timing disc is rotated for selectively generating trigger signals in response to the selective detection of predetermined areas on said timing disc tracks by said light detectors, each of said capacitive discharge circuit means including a storage capacitor, an ignition coil having a primary winding and electronic switch means for discharging said capacitor through said primary winding, conductor means connected to each capacitive discharge circuit means for charging the capacitor in each such capacitive discharge circuit means, said trigger signal from a sensor means consisting of a voltage decrease on the conductor means connected to the capacitive discharge circuit means associated with such sensor means, and means in each capacitive discharge circuit means responsive to a voltage decrease on the connected conductor means for triggering said electronic switch means in such capacitive discharge circuit means.

8. An ignition system for a multiple combustion chamber internal combustion engine, as set forth in claim 7, and further including timing means for periodically energizing said light sources in said sensor means each time a trigger signal is to be generated, said timing means including a second sensor means positioned to scan a predetermined outer track on said timing disc, said predetermined outer track having a separate predetermined area for each engine combustion chamber, said second sensor means generating a strobe signal in response to the detection of each of said separate predetermined areas, and means responsive to each strobe signal for simultaneously energizing said sensor means light sources.

9. An ignition system for a multiple combustion chamber internal combustion engine, as set forth in claim 8, and including a plurality of illuminated indicator means, and wherein a different one of said indicator means indicates a failure of each of said sensor means and each of said capacitive discharge circuit means.

10. An ignition system for a spark ignited internal combustion engine comprising, in combination, an ignition coil having primary and secondary windings, a storage capacitor, electronic switch means having input, output and control terminals, means connecting said capacitor, said primary winding and said input and output terminals of said switch means in a closed series circuit whereby energy stored in said capacitor is discharged through said primary winding when said switch means is triggered by a signal applied to said control terminal, a conductor connected to said capacitor, means for applying a constant current to said conductor for charging said capacitor, means responsive to a predetermined voltage change on said conductor for applying a trigger signal on said gate electrode of said switch means, and means for periodically causing such predetermined voltage change on said conductor in synchronism with the engine when sid switch means is to be triggered.

11. An ignition system for a spark ignited internal combustion engine, as set forth in claim 10, wherein such predetermined voltage change is voltage drop, and wherein said means for periodically causing such predetermined voltage drop includes second switch means connected to decrease the voltage on said conductor when closed and means for periodically closing said second switch means in synchronism with the engine.

* * * * *